US009453371B2

(12) United States Patent
Lu

(10) Patent No.: US 9,453,371 B2
(45) Date of Patent: Sep. 27, 2016

(54) ELECTRIC ROLLING DOOR

(71) Applicant: proeasy network solutions co., LTD., Hsinchu County (TW)

(72) Inventor: Hsing-Hung Lu, Hsinchu County (TW)

(73) Assignee: proeasy network solutions co., LTD., Hsinchu County (TW)

( * ) Notice: Subject to any disclaimer, the term of this patent is extended or adjusted under 35 U.S.C. 154(b) by 50 days.

(21) Appl. No.: 14/693,880

(22) Filed: Apr. 23, 2015

(65) Prior Publication Data

US 2016/0222728 A1 Aug. 4, 2016

(30) Foreign Application Priority Data

Feb. 4, 2015 (TW) ..... 104103714 A

(51) Int. Cl.

| | |
|---|---|
| ***E05F 15/00*** | (2015.01) |
| ***E06B 9/82*** | (2006.01) |
| ***E06B 9/70*** | (2006.01) |
| *E06B 9/68* | (2006.01) |
| *E06B 9/88* | (2006.01) |

(52) U.S. Cl.

CPC . *E06B 9/82* (2013.01); *E06B 9/70* (2013.01); *E06B 2009/6836* (2013.01); *E06B 2009/885* (2013.01)

(58) Field of Classification Search

CPC ..... E06B 2009/885; E06B 9/84; E06B 9/80; E05F 15/41; E05F 15/40; E05F 15/48; E05F 14/42

USPC ..... 160/1, 3, 4, 349.1, 90, 98, 108, 120

See application file for complete search history.

(56) References Cited

U.S. PATENT DOCUMENTS

| | | | | |
|---|---|---|---|---|
| 4,262,176 | A * | 4/1981 | Kapitza | E06B 9/88 160/133 |
| 5,261,186 | A * | 11/1993 | Saino | E05F 1/006 160/1 |
| 6,651,385 | B2 * | 11/2003 | Miller | E05F 15/43 49/199 |
| 7,159,637 | B2 * | 1/2007 | Snyder | E06B 3/485 160/121.1 |
| 9,187,953 | B2 * | 11/2015 | Drifka | E06B 9/13 |
| 2007/0095488 | A1 * | 5/2007 | Huang | E06B 9/80 160/310 |
| 2007/0131358 | A1 * | 6/2007 | Iwasaki | E06B 9/58 160/133 |

(Continued)

FOREIGN PATENT DOCUMENTS

| | | | |
|---|---|---|---|
| CH | 682339 A5 * | 8/1993 | E06B 9/325 |
| CN | 2251191 | 4/1997 | |

(Continued)

*Primary Examiner* — Katherine Mitchell
*Assistant Examiner* — Johnnie A Shablack
(74) *Attorney, Agent, or Firm* — Jianq Chyun IP Office

(57) ABSTRACT

An electric rolling door including a rail, a rolling door coupled to the rail, a control module connected to the rolling door to drive the rolling door moved along the rail, a rotating member, a sensing module, and a weighting member is provided. The rotating member is pivoted along an axis next to the rail, wherein the axis is parallel to an extending direction of the rail. The sensing module electrically connected to the control module is disposed on the axis and senses a motion of the rotating member. The weighting member freely pivoted to a bottom of the rolling door has a weighting portion and a pressing portion extending between the rail and the rotating member. A first torque generated by the weighting portion relative to the rolling door is greater than and opposite to a second torque generated by the pressing portion relative to the rolling door.

13 Claims, 7 Drawing Sheets

(56) References Cited

U.S. PATENT DOCUMENTS

| | | | | |
|---|---|---|---|---|
| 2010/0032105 | A1* | 2/2010 | Drifka | E06B 9/13 160/8 |
| 2010/0212227 | A1* | 8/2010 | Perkins | E01F 13/048 49/70 |
| 2013/0112354 | A1* | 5/2013 | Hardison, III | E06B 9/581 160/127 |
| 2015/0292262 | A1* | 10/2015 | Miller | E06B 9/13 160/270 |

FOREIGN PATENT DOCUMENTS

| | | | | |
|---|---|---|---|---|
| DE | 102005010144 | A1 * | 9/2006 | E05B 65/0021 |
| DE | 202014008457 | U1 * | 12/2014 | F16P 3/12 |
| FR | EP 1862635 | A1 * | 12/2007 | E06B 9/80 |
| JP | WO 2007049392 | A1 * | 5/2007 | E06B 9/84 |
| JP | WO 2008056460 | A1 * | 5/2008 | E05D 13/006 |
| TW | 375188 | | 11/1999 | |
| TW | M246447 | | 10/2004 | |

* cited by examiner

ELECTRIC ROLLING DOOR

CROSS-REFERENCE TO RELATED APPLICATION

This application claims the priority benefit of Taiwan application serial no. 104103714, filed on Feb. 4, 2015. The entirety of the above-mentioned patent application is hereby incorporated by reference herein and made a part of this specification.

BACKGROUND OF THE INVENTION

1. Field of the Invention

The invention relates to an electric rolling door.

2. Description of Related Art

Conveniently rollable and practical in space utilization, the rolling door is widely used in modern buildings. Conventional electric rolling doors mainly use motor drive as the driving force for opening and shutting operations to achieve convenient and effort-saving operations of opening and shutting rolling doors. Although electric rolling doors are less effort-taking and more convenient, in terms of safety in actual use, dangerous cases such as being hit or pinched frequently occur due to carelessness and negligence of the user. In particular, in an operation of shutting an electric rolling door, if there is a foreign object placed below the rolling door, or a kid or person suddenly approaches or enters, accidents tend to occur because the whole operation is electrically and automatically executed, and the user may not notice the rolling operation of the rolling door, or the user is even absent from the scene.

SUMMARY OF THE INVENTION

The invention provides an electric rolling door having an anti-pinch effect.

The electric rolling door of the invention includes a rail, a rolling door, a control module, a rotating member, a sensing module, and a weighting member. The rolling door is coupled to the rail. The control module is connected to the rolling door to control the rolling door to move along the rail. The rotating member is pivotally provided beside the rail along an axis that is parallel to an extension direction of the rail. The sensing module is provided on the axis to detect a rotation motion of the rotating member, and the sensing module is electrically connected to the control module. The weighting member is freely pivotally connected to a bottom of the rolling door. The weighting member includes a weighting portion and a pressing portion. The pressing portion extends to between the rail and the rotating member, wherein a first torque generated by the weighting portion relative to the rolling door is greater than a second torque generated by the pressing portion relative to the rolling door, and the first torque and the second torque are in opposite directions.

In one embodiment of the invention, the weighting member switches between a first state and a second state relative to the rolling door. When the weighting member is in the first state, the weighting portion is located below the bottom of the rolling door. When an object abuts upward the weighting portion from below the bottom of the rolling door, the object drives the weighting member by a third torque to rotate from the first state to the second state and the pressing portion pushes the rotating member to rotate in the axis. The third torque and the second torque are in the same direction and the third torque is greater than the first torque.

In one embodiment of the invention, when the weighting member is in the first state, the pressing portion contacts the rail. When the weighting member is in the second state, the pressing portion departs from the rail and abuts and pushes the rotating member.

In one embodiment of the invention, the weighting member includes a pivoting portion freely pivotally connected to the bottom of the rolling door. The pressing portion extends from the pivoting portion to between the rail and the rotating member, and the weighting portion and the pressing portion are located at two opposite sides of the pivoting portion.

In one embodiment of the invention, the weighting portion, the pressing portion and the pivoting portion are an integrally formed rigid body structure.

In one embodiment of the invention, the weighting portion is pivotally connected to the side of the pivoting portion away from the pressing portion, and the weighting portion is slidably coupled to the rolling door. When the weighting member is in the first state, the weighting portion protrudes below the bottom of the rolling door. When the weighting member is in the second state, the weighting portion withdraws in the bottom of the rolling door.

In one embodiment of the invention, the rotating member is pivotally provided beside the rail in a first axis and the weighting member is pivotally connected to the rolling door in a second axis, wherein the first axis is orthogonal to the second axis.

In one embodiment of the invention, the electric rolling door further includes a pair of rails, a case body, and a pair of rotating members. The rolling door is slidably coupled between the rails. The case body is connected to above the rails and accommodates the rolled-up rolling door. The rotating members are respectively pivotally connected to beside the rails.

In one embodiment of the invention, the weighting member includes a weighting portion and a pair of pressing portions. The weighting portion is a rigid body structure crossing over between the rails. The pressing portions respectively extend from two opposite ends of the weighting portion toward between the rails and the rotating members.

In one embodiment of the invention, the rotating member includes a panel, a hinge, and a rotating disc. The panel is connected to the rail via the hinge. The rotating disc and the hinge are provided together in the same axis. The sensing module is provided beside the rotating disc to detect a rotating status of the rotating disc.

In one embodiment of the invention, the sensing module includes a light source and an optical sensor between which an optical sensing path is formed. The rotating disc further has an aperture, and the light source and the optical sensor are respectively located at two opposite sides of the aperture. When the rotating disc rotates in the axis along with the hinge, the aperture passes through the optical sensing path.

In one embodiment of the invention, the electric rolling door further includes a bracket and at least one roller. The bracket is provided at the bottom of the rolling door, and an end of the bracket extends to the rail. The roller is provided at the end of the bracket and rollably abuts the rail.

In one embodiment of the invention, the bracket includes a pair of branches extending to the rail, and the electric rolling door further includes a pair of rollers respectively provided on the pair of branches and abutting inner and outer surfaces of the rail.

In light of the above, through structural mutual coordination of the weighting member and the rotating member, the electric rolling door enables the sensing module to detect the rotating status of the rotating member. Accordingly, when the rolling door is pulled down and abuts a person or an object, the motor is controlled to stop driving the rolling door, and the anti-pinch effect is thereby achieved.

To provide a further understanding of the aforementioned and other features and advantages of the invention, exemplary embodiments, together with the reference drawings, are described in detail below.

DESCRIPTION OF THE EMBODIMENTS

Figure 1:
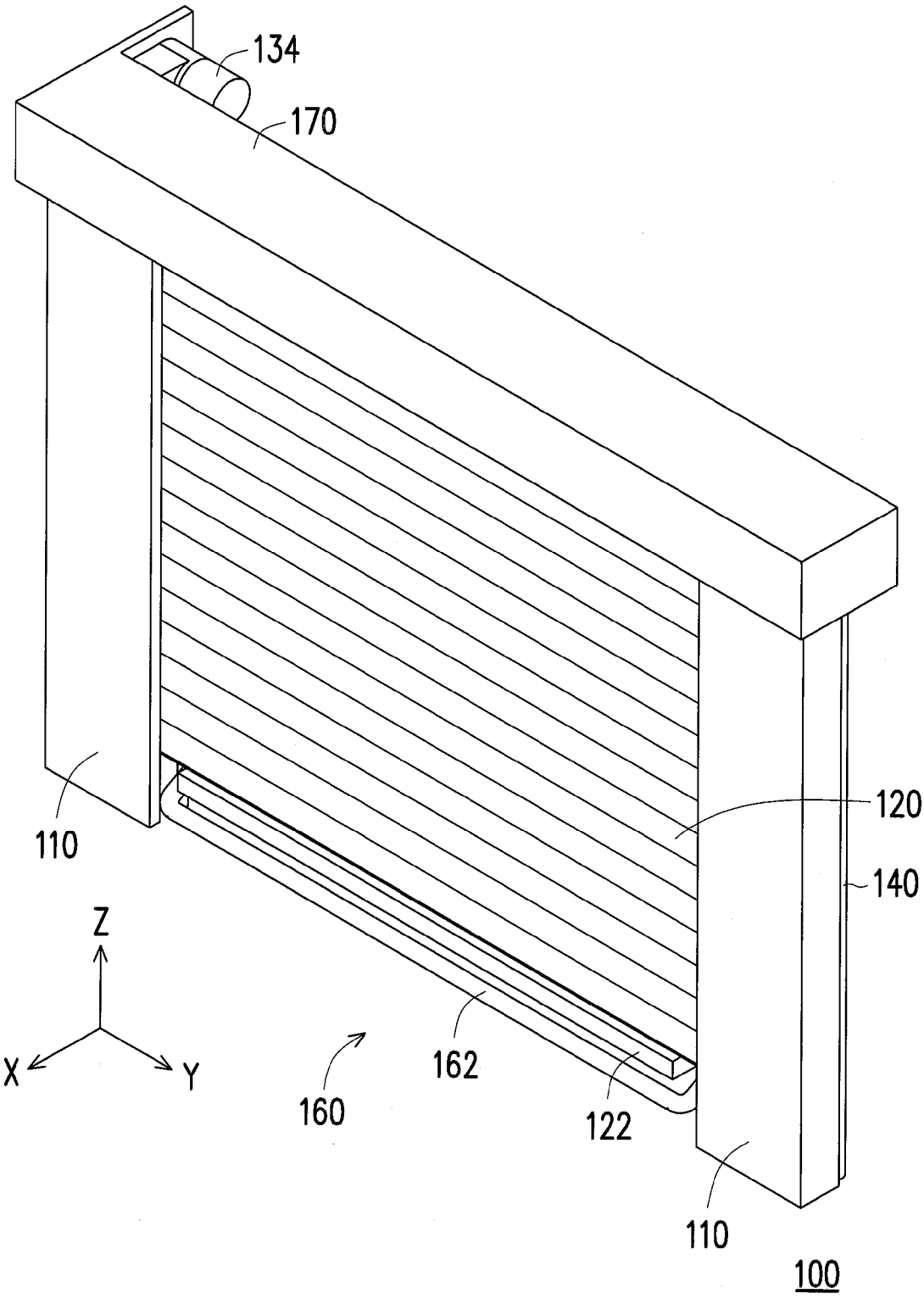
FIG. 1 is a schematic view of an electric rolling door according to one embodiment of the invention.
Figure 2:
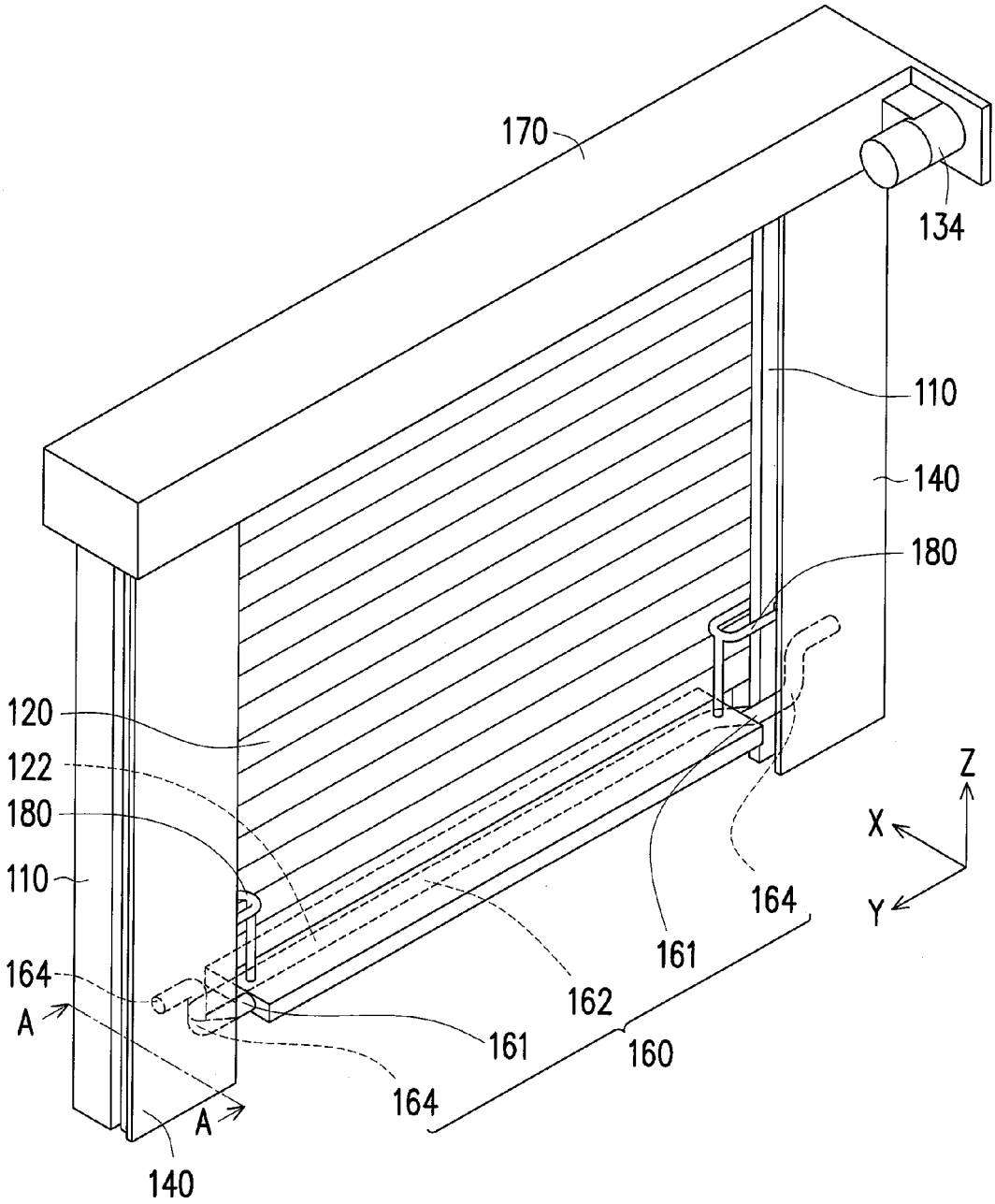
FIG. 2 is a schematic view of the electric rolling door of FIG. 1 from another perspective.
Figure 3:
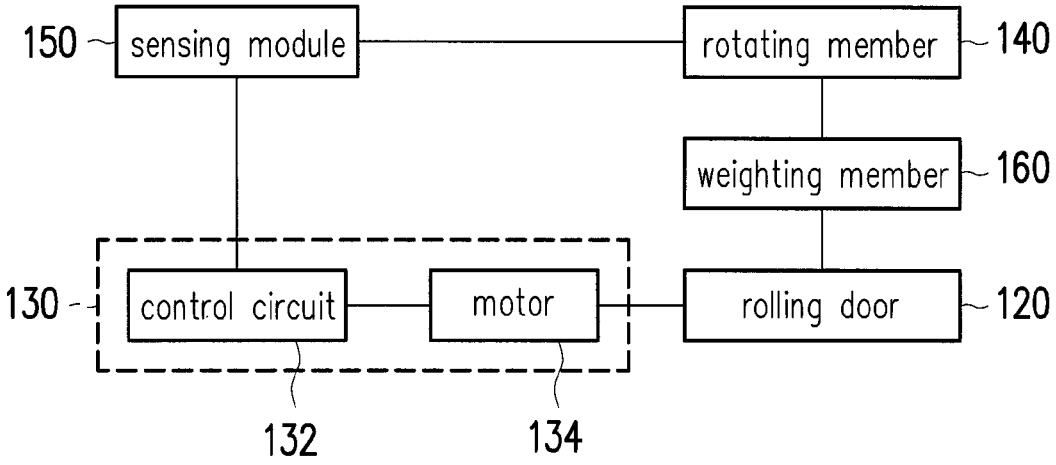
FIG. 3 is a schematic view of connection between part of components in the electric rolling door of FIG. 1 and FIG. 2.

FIG. 1 is a schematic view of an electric rolling door according to one embodiment of the invention. FIG. 2 is a schematic view of the electric rolling door of FIG. 1 from another perspective, wherein part of components blocked from view are rendered in broken lines. FIG. 3 is a schematic view of connection between part of components in the electric rolling door of FIG. 1 and FIG. 2, whereby structures and electrical relations between relevant components are described. Meanwhile, rectangular coordinates are provided to facilitate description of relevant structures. Referring to FIG. 1 to FIG. 3, in the present embodiment, an electric rolling door 100 includes a rail 110, a rolling door 120, a control module 130, a rotating member 140, a sensing module 150, and a weighting member 160. Specifically speaking, the electric rolling door 100 includes a pair of the rails 110 provided on left and right sides. The rolling door 120 is coupled between the rails 110, and a case body 170 is additionally provided above the rails 110. The control module 130 includes a control circuit 132 provided inside or at a periphery of the case body 170 and a motor 134 provided outside the case body 170. In addition, the motor 134 is connected to the rolling door 120 (here, the motor 134 drives the rolling door 120 by a hinge, for example, which can be known from the prior art and will not be further described here), so that by controlling the motor 134, the control circuit 132 drives the rolling door 120 to move upward and downward along the rails 110 and to be rolled and stowed in the case body 170. The aforementioned moving upward and downward means that the rolling door 120 moves along a Z axis. The rotating member 140 is pivotally connected beside the rail 110 along the Z axis and is parallel to an extension direction of the rail 110. The weighting member 160 is freely pivotally connected to a bottom 122 of the rolling door 120 along a Y axis.

Figure 4A:
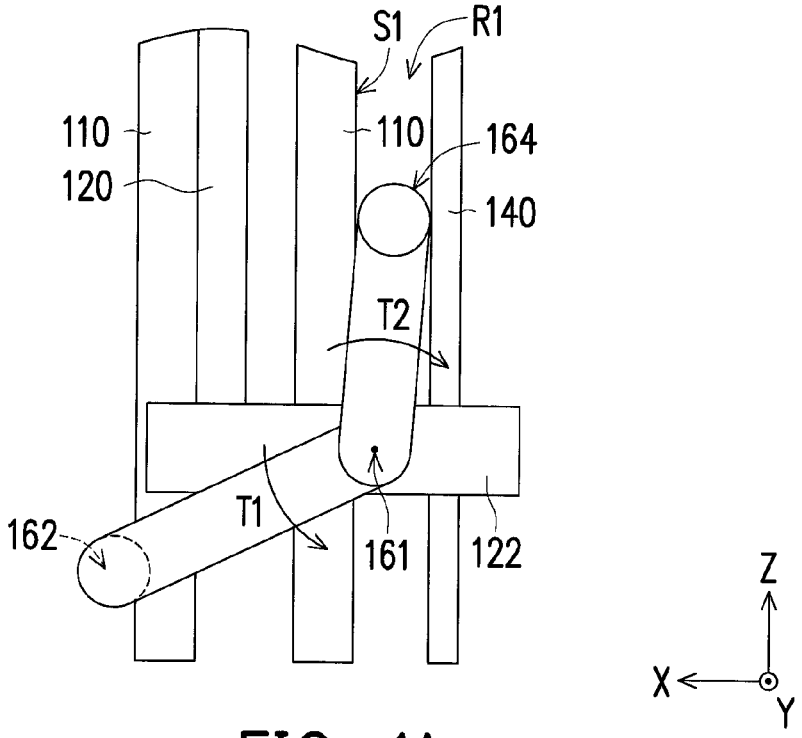
FIG. 4A and FIG. 4B are partially enlarged side views of a weighting member and a rolling door.
Figure 4B:
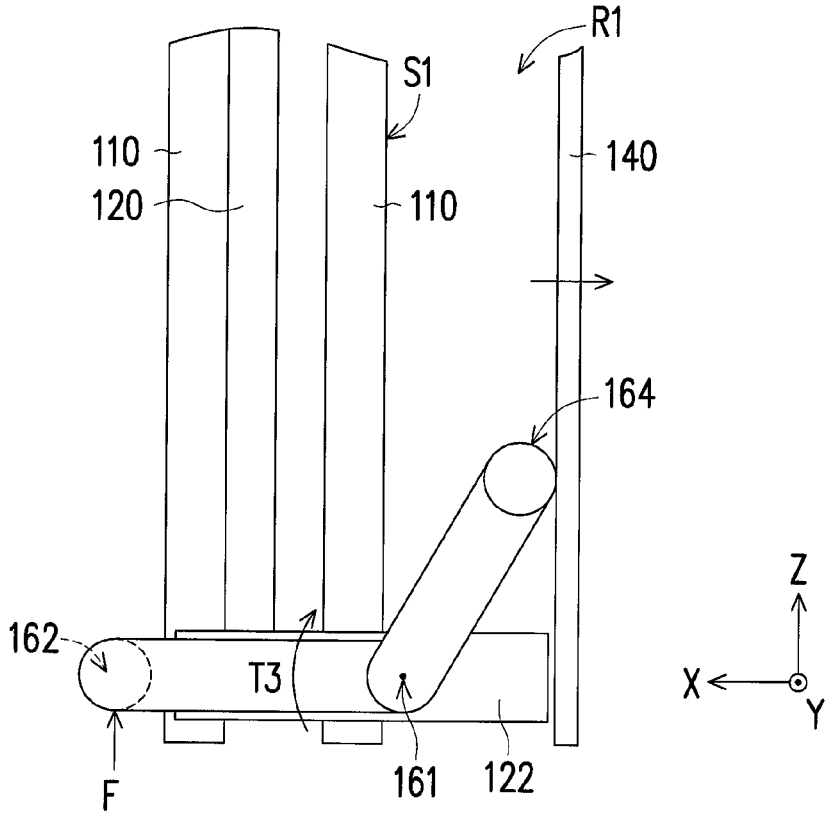

FIG. 4A and FIG. 4B are partially enlarged side views of the weighting member and the rolling door that partially illustrate components on a left side in FIG. 2 along an A-A section line for illustrating different states of the weighting member 160 relative to the rolling door 120. Referring to FIG. 1, FIG. 2, FIG. 4A, and FIG. 4B, in the present embodiment, the weighting member 160 includes a pivoting portion 161, a weighting portion 162, and a pressing portion 164, wherein the pivoting portion 161 is pivotally connected to the bottom 122 of the rolling door 120, the weighting portion 162 extends from the pivoting portion 161 toward a positive direction of an X axis, and the pressing portion 164 extends from the bottom 122 of the rolling door 120 (namely, from the pivoting portion 161) to between the rail 110 and the rotating member 140. Specifically speaking, the weighting portion 162 is a rigid body structure crossing over between the pair of rails 110 (namely, the weighting portion, the pressing portion and the pivoting portion are an integrally formed rigid body structure). As illustrated in FIG. 1 and FIG. 2, the weighting portion 162 of the present embodiment is a shaft, but the present embodiment is not limited thereto. Any rigid body structure (e.g., a panel and a frame) that can be provided at the bottom 122 of the rolling door 120 can equally serve as the weighting portion 162. Moreover, a pair of the pressing portions 164 respectively extends from two opposite ends of the weighting portion 162 and the pivoting portion 161 toward a negative direction of the X axis, a positive direction of the Z axis, and then extends into a room R1 between the rail 110 and the rotating member 140 along the Y axis. This configuration also makes the weighting portion 162 crossing over between the rails 110 have a weight substantially greater than the pressing portions 164 at two sides of the weighting portion 162 because of a volume of the weighting portion 162 is greater than a volume of the pressing portions 164 (namely, leading to an effect of a first torque T1 being greater than a second torque T2 as described below). In the invention, a designer may appropriately adjust the appearance, structure, and weight arrangement of the weighting member to achieve a desired weighting effect.

Accordingly, since the weighting member 160 is freely pivotally connected to the bottom 122 of the rolling door 120, when the weighting member 160 is not subjected to an external force, the weighting member 160 is in a first state (as illustrated in FIG. 4A). A free torque (marked as the first torque T1 here) generated by the weighting portion 162 relative to the rolling door 120 due to a dead weight of the weighting portion 162 is greater than a free torque (marked as the second torque T2 here) generated by the pressing portion 164 relative to the rolling door 120 due to a dead weight of the pressing portion 164. In other words, when the rolling door 120 is displaced off the ground and is in the first state without pressing any object, because of a relative relation between the first torque T1 and the second torque T2, the weighting portion 162 hangs below the bottom 122 of the rolling door 120 (as illustrated in FIG. 4A). At this time, the pressing portion 164 contacts an outer surface S1 of the rail 110. Correspondingly, when the rolling door 120 abuts the ground or an object, the ground and the object press upward the weighting portion 162 by an external force F and generate a third torque T3. Thereby, the weighting portion 162 is moved to the same horizontal plane as the bottom 122 of the rolling door 120, and the pressing portion 164 rotates clockwise due to an action of the third torque T3 (switching from the first state in FIG. 4A to a second state in FIG. 4B) to push the rotating member 140 to rotate in the Z axis.

Figure 5A:
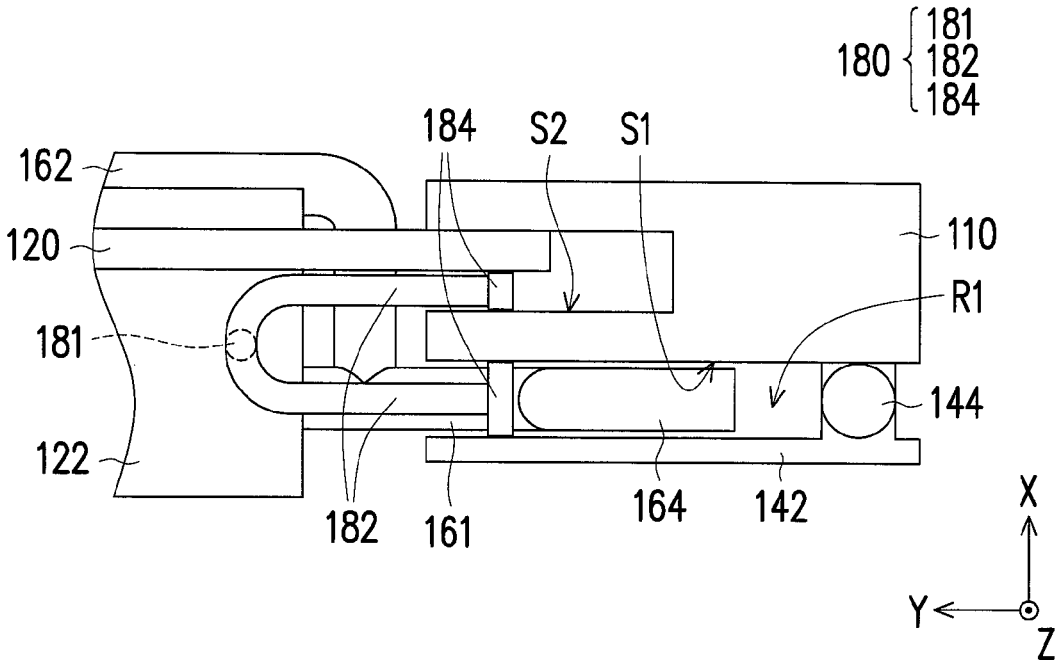
FIG. 5A and FIG. 5B are partially enlarged top views of the weighting member, the rolling door, and a rotating member.
Figure 5B:
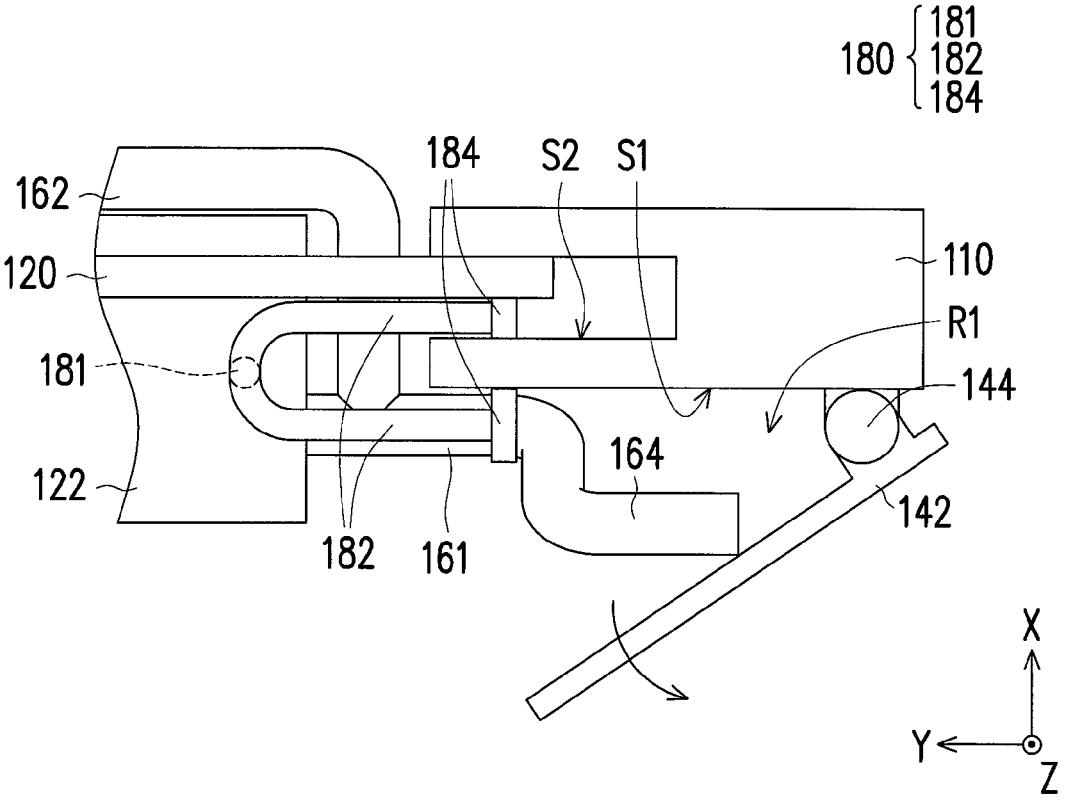
Figure 6:
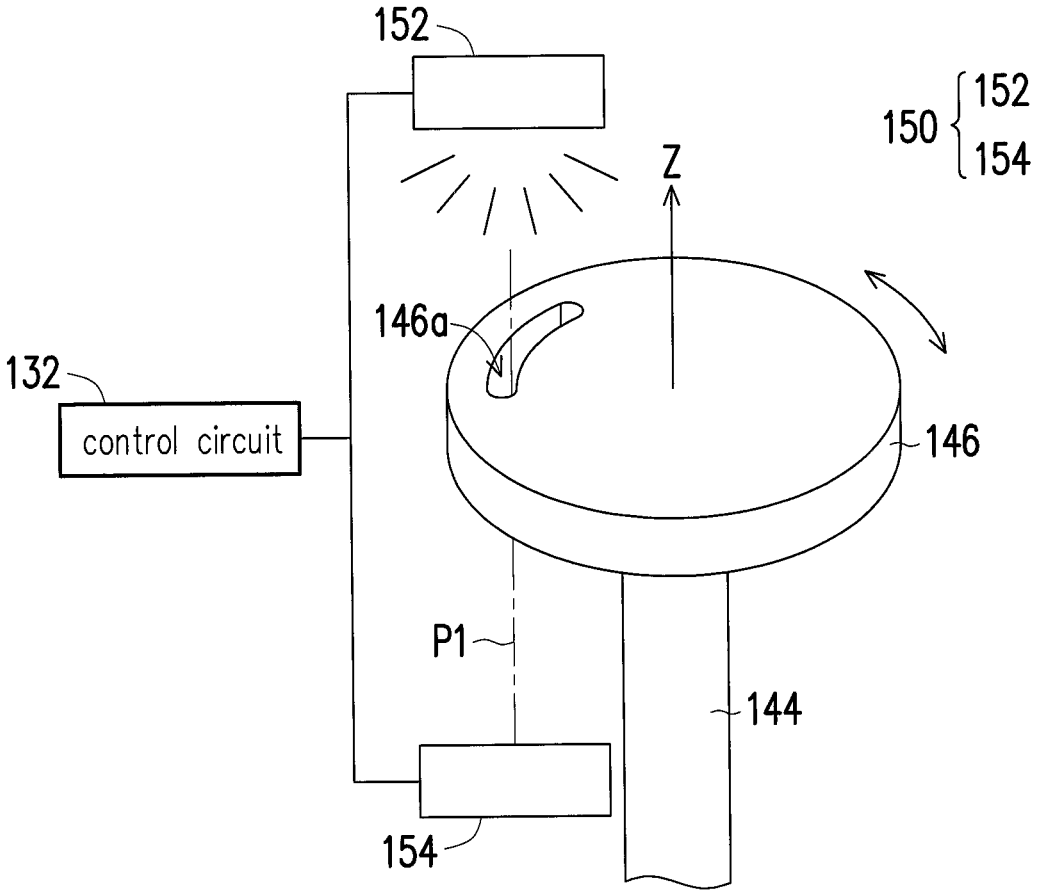
FIG. 6 is a partial schematic view of the rotating member.

FIG. 5A and FIG. 5B are partially enlarged top views of the weighting member, the rolling door, and the rotating member. Referring to FIG. 5A and FIG. 5B with reference to FIG. 4A and FIG. 4B, as described above, since the ground or the object presses upward the weighting portion 162 by the external force F and generates the third torque T3, the weighting member 160 is rotated (namely, the weighting member 160 rotates in the Y axis), which causes the pressing portion 164 to push the rotating member 140 to rotate in the Z axis, switching from the first state in FIG. 5A to the second state in FIG. 5B. Moreover, FIG. 6 is a partial schematic view of the rotating member. Referring to FIG. 5A, FIG. 5B, and FIG. 6, in the present embodiment, the rotating member 140 includes a panel 142, a hinge 144, and a rotating disc 146, wherein the panel 142 is connected to the outer surface S1 of the rails 110 via the hinge 144. The rotating disc 146 and the hinge 144 are provided together in the same axis (Z).

The sensing module 150 is provided beside the rotating disc 146 to sense a rotating status of the rotating disc 146. Specifically speaking, the sensing module 150 includes a light source 152 and an optical sensor 154 between which an optical sensing path P1 is formed. The rotating disc 146 further includes an aperture 146*a,* and the light source 152 and the optical sensor 154 are respectively located at two opposite sides of the aperture 146*a* in the Z axis. When the rotating disc 146 rotates along with the hinge 144 in the Z axis, the aperture 146*a* passes through the optical sensing path P1. Accordingly, the optical sensor 154 identifies the rotating status of the rotating member 140 according to whether light generated from the light source 152 is received.

In light of the above, since the structural arrangement of the weighting member 160 configures the first torque Ti of the weighting portion 162 to be greater than the second torque T2 of the pressing portion 164, when the rolling door 120 moves along the rails 110 and does not abut the ground or an object, the weighting portion 162 of the weighting member 160 is substantially located below the bottom 122 of the rolling door 120 due to the aforementioned torque relation. Accordingly, when the rolling door 120 is pulled down and there is a person or an object below the rolling door 120, the weighting portion 162 abuts the person or the object first, which further drives the weighting member 160 to rotate by the third torque T3, such that the pressing portion 164 pushes the panel 142 to move to achieve a movement effect of rotating the rotating member 140 in the Z axis. Meanwhile, through the corresponding arrangement between the sensing module 150 and the rotating disc 146, the sensing module 150 detects the rotation of the rotating member 140 and accordingly sends a signal to the control circuit 132 to further enable the control circuit 132 to control the motor 134 to stop driving the rolling door 120. Therefore, through the above-described component arrangement, the electric rolling door 100 of the invention achieves an anti-pinch effect. In addition, as described above, the weighing portion 162 of the weighting member 160 is a rigid body structure crossing over between the rails 110, which means the entire area below the rolling door 120 is an abutting area of the weighting portion 162, and the anti-pinch effect may be achieved without fail when the rolling door is pulled down. Moreover, the rotating member 140 of the present embodiment is further provided with an elastic member (not illustrated), which may be a torsion spring provided on the hinge 144 or a retractable spring connected between the panel 142 and the rail 110, for example, for restoring the panel 142 from the state illustrated in FIG. 4B and FIG. 5B to the state illustrated in FIG. 4A and FIG. 5A.

On the other hand, referring again to FIG. 2, FIG. 5A, and FIG. 5B, to prevent the pressing portion 164 from affecting the rotating member 140 due to abnormal swinging generated in the X axis when the rolling door 120 moves in the rails 110 along the Z axis, the electric rolling door 100 of the present embodiment further includes a bracket 180 and at least one roller 184, wherein the roller 184 is provided on the bracket 180 and rollably abuts the rail 110. Specifically speaking, the bracket 180 includes a first component 181 and a second component 182, wherein the first component 181 extends from the bottom 122 of the rolling door 120 along the Z axis, and the second component 182 is a pair of branches extending from the first component 181 along the Y axis. Ends of the pair of the branches extend to the rail 110. A pair of the rollers 184 are respectively provided on the second component 182 (the branches), and the rollers 184 respectively rollably abut an inner surface S2 and the outer surface S1 of the rail 110. Accordingly, the bracket 180 and the rollers 184 provide guiding and position limiting effects for the rolling door 120, such that the rolling door 120 moves straight up and straight down in the rails 110 along the Z axis without swinging.

Figure 7A:
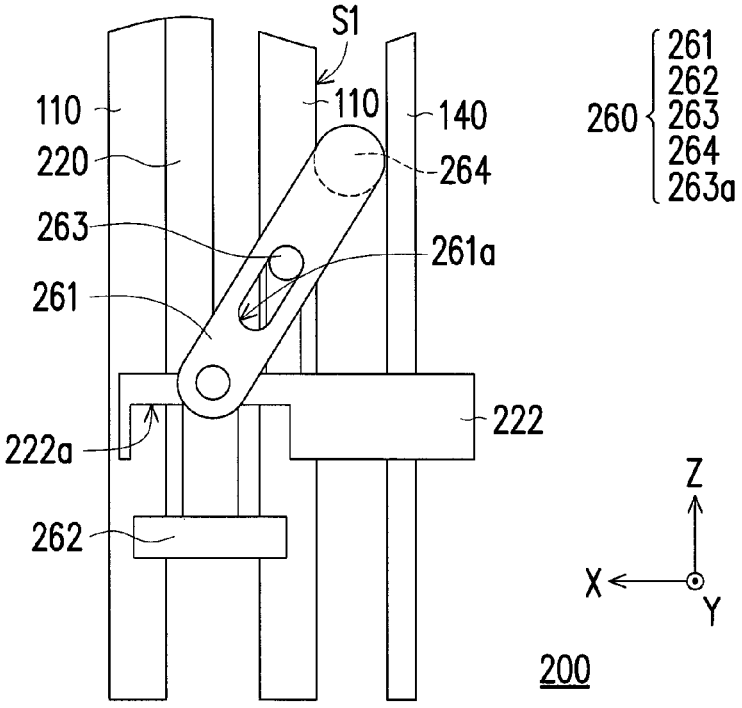
FIG. 7A and FIG. 7B are partial schematic views of an electric rolling door of another embodiment of the invention.
Figure 7B:
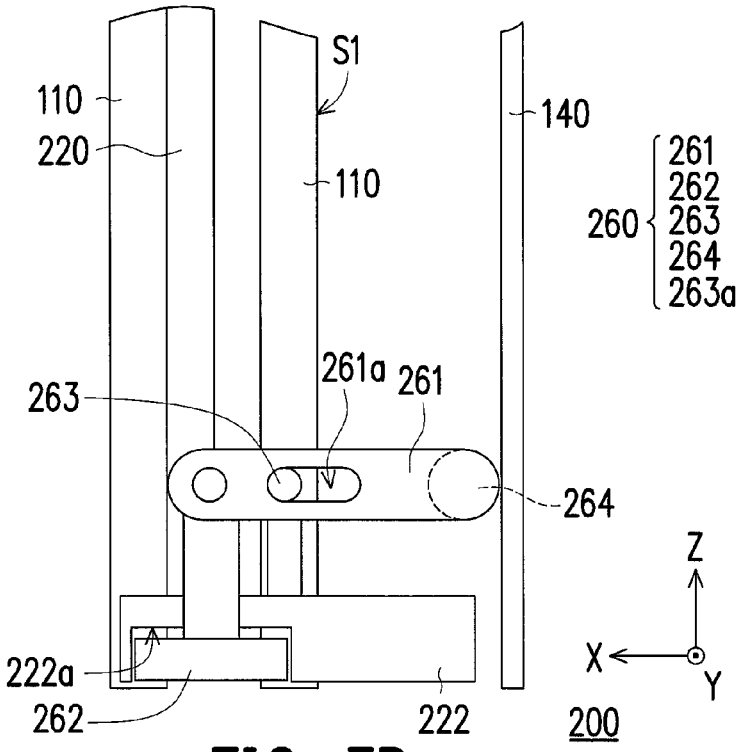

Similar to FIG. 4A and FIG. 4B above, FIG. 7A and FIG. 7B are partial schematic views of an electric rolling door of another embodiment of the invention for illustrating different states of a weighting member relative to a rolling door. Referring to FIG. 7A and FIG. 7B, in the present embodiment, an electric rolling door 200 differs from the aforementioned in that a weighting portion 262 of a weighting member 260 is provided at a bottom 222 of a rolling door 220 to be movable along a Z axis. Specifically speaking, the bottom 222 of the rolling door 220 has a containing recess 222*a,* and the weighing portion 262 is configured in an inverse-T structure and is slidably provided at the bottom 222. Therefore, when the rolling door 220 is displaced off the ground and does not abut any person or object, the weighting portion 262 moves downward due to the dead weight thereof and protrudes below the containing recess 222*a.* Once the rolling door 220 abuts any person or object in a pull-down process, the person or the object presses the weighting portion 262 first, which further drives the weighting portion 262 to move upward and withdraw in the containing recess 222*a.* Moreover, a pivoting shaft 263 extends from the bottom 222 of the rolling door 220 (first extending from the bottom 222 along a positive direction of the Z axis, and then extending along a positive direction of a Y axis), and a pivoting portion 261 of the weighting member 260 is slidably pivotally connected to the pivoting shaft 263 via an elongated opening 261 a. The weighting portion 262 is pivotally connected to one end of the pivoting portion 261. A pressing portion 264 of the weighting member 260 extends along the Y axis from another end of the pivoting portion 261 to between the rotating member 140 and the outer surface S1 of the rail 110.

Accordingly, when the weighting portion 262 moves upward and withdraws in the containing recess 222*a,* the pivoting portion 261 is simultaneously driven to slide and rotate relative to the pivoting shaft 263, which further enables the pressing portion 264 to drive a panel of the rotating member 140 to rotate in the Z axis. Therefore, similar to the foregoing embodiment, the present embodiment pushes the rotating member to stop a motor from driving the rolling door via a sensing module and a control module, and an anti-pinch effect is thereby achieved. Note that although the weighting member 260 of the present embodiment is illustrated in the side views, it is similar to the foregoing embodiment, namely, the weighting portion 262 being a rigid body structure crossing over between the rails 110 to achieve the anti-pinch effect without fail when the rolling door 220 is pulled down.

In summary of the aforementioned, in the electric rolling door of the foregoing embodiments of the invention, through structural mutual coordination of the weighting member and the rotating member (namely, freely coupling the weighting portion of the weighting member to the rolling door), the weighting portion is located below the bottom of the rolling door due to the weight of the weighing member when the weighing member is not subjected to an external force. Therefore, when the rolling door is being pulled own, before the rolling door abuts a person or a foreign object, the weighting portion abuts the person or the foreign object and enables the pressing portion to push the panel of the rotating member, such that the sensing module detects the rotation status of the rotating member and accordingly controls the motor to stop driving the rolling door. Thereby, the anti-pinch effect is achieved.

Although the invention is disclosed in the embodiments above, the embodiments are not meant to limit the invention. Any person skilled in the art may make slight modifications and variations without departing from the spirit and scope of the invention. Therefore, the protection scope of the invention shall be defined by the claims attached below.

What is claimed is:

1. An electric rolling door, comprising:

a rail;

a rolling door coupled to the rail;

a control module connected to the rolling door to control the rolling door to move along the rail;

a rotating member pivotally provided beside the rail along an axis that is parallel to an extension direction of the rail;

a sensing module provided on the axis to detect a rotation motion of the rotating member, the sensing module being electrically connected to the control module; and a weighting member freely pivotally connected to a bottom of the rolling door and comprising a weighting portion and a pressing portion, wherein the pressing portion extends to between the rail and the rotating member, wherein a first torque generated by the weighting portion relative to the rolling door is greater than a second torque generated by the pressing portion relative to the rolling door, and the first torque and the second torque are in opposite directions.

2. The electric rolling door according to claim 1, wherein the rotating member is pivotally provided beside the rail in a first axis and the weighting member is pivotally connected to the rolling door in a second axis, wherein the first axis is orthogonal to the second axis.

3. The electric rolling door according to claim 1, further comprising:

a pair of rails, between which the rolling door is slidably coupled;

a case body which is connected to above the pair of rails and which accommodates the rolled-up rolling door; and a pair of rotating members respectively pivotally connected to beside the pair of rails.

4. The electric rolling door according to claim 3, wherein the weighting member comprises a weighting portion and a pair of pressing portions, wherein the weighting portion is a rigid body structure crossing over between the pair of rails, and the pair of pressing portions respectively extend from two opposite ends of the weighting portion toward between the pair of rails and the pair of rotating members.

5. The electric rolling door according to claim 1, wherein the rotating member comprises a panel, a hinge, and a rotating disc, wherein the panel is connected to the rail via the hinge, and the rotating disc and the hinge are provided together in the same axis, wherein the sensing module is provided beside the rotating disc to detect a rotating status of the rotating disc.

6. The electric rolling door according to claim 5, wherein the sensing module comprises a light source and an optical sensor between which an optical sensing path is formed, wherein the rotating disc further has an aperture, wherein the light source and the optical sensor are respectively located at two opposite sides of the aperture, wherein when the rotating disc rotates in the axis along with the hinge, the aperture passes through the optical sensing path.

7. The electric rolling door according to claim 1, further comprising:

a bracket provided at the bottom of the rolling door, an end of the bracket extending to the rail; and at least one roller provided at the end of the bracket and rollably abutting the rail.

8. The electric rolling door according to claim 7, wherein the bracket comprises a pair of branches extending to the rail, and the electric rolling door further comprises a pair of rollers respectively provided on the pair of branches and abutting inner and outer surfaces of the rail.

9. The electric rolling door according to claim 1, wherein the weighting member switches between a first state and a second state relative to the rolling door, wherein when the weighting member is in the first state, the weighting portion is located below the bottom of the rolling door, wherein when an object abuts upward the weighting portion from below the bottom of the rolling door, the object drives the weighting member by a third torque to rotate from the first state to the second state and the pressing portion pushes the rotating member to rotate in the axis, wherein the third torque and the second torque are in the same direction and the third torque is greater than the first torque.

10. The electric rolling door according to claim 9, wherein when the weighting member is in the first state, the pressing portion contacts the rail, and when the weighting member is in the second state, the pressing portion departs from the rail and abuts and pushes the rotating member.

11. The electric rolling door according to claim 9, wherein the weighting member comprises:

a pivoting portion freely pivotally connected to the bottom of the rolling door, wherein the pressing portion extends from the pivoting portion to between the rail and the rotating member, and the weighting portion and the pressing portion are located at two opposite sides of the pivoting portion.

12. The electric rolling door according to claim 11, wherein the weighting portion, the pressing portion and the pivoting portion are an integrally formed rigid body structure.

13. The electric rolling door according to claim 11, wherein the weighting portion is pivotally connected to the side of the pivoting portion away from the pressing portion, and the weighting portion is slidably coupled to the rolling door, wherein when the weighting member is in the first state, the weighting portion protrudes below the bottom of the rolling door, wherein when the weighting member is in the second state, the weighting portion withdraws in the bottom of the rolling door.

* * * * *